US007133002B2

(12) United States Patent
Langlois

(10) Patent No.: US 7,133,002 B2
(45) Date of Patent: Nov. 7, 2006

(54) PORTABLE DISPLAY SYSTEM

(75) Inventor: Daniel Langlois, 3530, Saint-Laurent Boulevard, Montreal, Quebec (CA) H2X 2V1

(73) Assignee: Daniel Langlois, Montreal (CA)

( * ) Notice: Subject to any disclaimer, the term of this patent is extended or adjusted under 35 U.S.C. 154(b) by 503 days.

(21) Appl. No.: 10/389,614

(22) Filed: Mar. 17, 2003

(65) Prior Publication Data

US 2003/0231166 A1 Dec. 18, 2003

(30) Foreign Application Priority Data

Mar. 15, 2002 (CA) ..... 2376896

(51) Int. Cl.
*G09G 5/00* (2006.01)

(52) U.S. Cl. ..... 345/8; 40/586; 348/838

(58) Field of Classification Search ..... 345/8, 345/31, 156, 157, 158, 159, 160, 161, 162, 345/163, 164; 361/681; 40/586; 348/838
See application file for complete search history.

(56) References Cited

U.S. PATENT DOCUMENTS

| | | | | |
|---|---|---|---|---|
| 4,158,490 | A | 6/1979 | Gottschalk et al. | |
| 5,222,642 | A | 6/1993 | Solarz | |
| 5,390,246 | A | 2/1995 | Gay et al. | |
| 5,690,411 | A | 11/1997 | Jackman | |
| 5,762,251 | A * | 6/1998 | Gleason | 224/635 |
| 5,774,338 | A | 6/1998 | Wessling, III | |
| 5,892,445 | A * | 4/1999 | Tomich | 340/573.1 |
| 5,912,653 | A | 6/1999 | Fitch | |
| 6,015,076 | A | 1/2000 | Pennington | |
| 6,047,301 | A | 4/2000 | Bjorklund et al. | |
| 6,057,966 | A | 5/2000 | Carroll et al. | |
| 6,140,981 | A | 10/2000 | Kuenster et al. | |
| 6,393,745 | B1 * | 5/2002 | Miki | 40/586 |
| 6,650,305 | B1 * | 11/2003 | Havey et al. | 345/8 |
| 6,843,012 | B1 * | 1/2005 | Dodd | 40/586 |

FOREIGN PATENT DOCUMENTS

| | | |
|---|---|---|
| FR | 2 608 823 | 6/1988 |
| JP | 2000298445 | 10/2000 |

* cited by examiner

*Primary Examiner*—Richard Hjerpe
*Assistant Examiner*—Jean Lesperance
(74) *Attorney, Agent, or Firm*—Robert Brouillette

(57) ABSTRACT

The invention relates to portable dynamic display device, which may be used with for instance advertising using multimedia presentations. The device of the invention may be configured to be mounted on a human body and carried from place to place while displaying a video image and playing an audio track.

22 Claims, 6 Drawing Sheets

PORTABLE DISPLAY SYSTEM

The present invention relates to a portable dynamic display device. The device of the invention can be used, for example, as an advertising device using audiovisual presentations of digital image files, digital video files, and/or digital audio files.

Various methods for advertising exist today in abundance. Many of the more common methods of advertising include billboards and signs, which are posted in locations frequented by many people. These methods of advertising while useful have a significant drawback in that they require large amounts of space. There is therefore a limited amount of signs and billboards which can be placed in an area before the area becomes saturated. Furthermore, signs and billboards often require significant effort to change advertising should one desire replace an old advertisement with a new advertisement.

Other less frequent methods of advertising include wearable signs which are carried by a human operator in a populated area. This method solves some of the problems of space which are involved with normal signs and billboards, though the wearable signs can often be quite uncomfortable for the wearer. Additionally the wearable signs are still static and need to be replaced if a new advertisement is desired.

Recently as technology has progressed, and miniaturisation techniques have been improved, several types of portable electronic devices have been made available. These sort of devices include a range of devices from portable telephones to personal computer which can be mounted on a person's body. Examples of these kinds of devices can be seen in for instance U.S. Pat. No. 6,140,981 to Kuenster et al, and U.S. Pat. No. 6,057,966 to Carroll et al.

There has also been attempts at including video images on garments, see for example U.S. Pat. No. 5,912,653 to Stephan Fitch. This device while allowing changeable images on a person, are not useful for large scale advertising since the display has to be of reduced weight to prevent tearing of the garment.

As can be seen from the prior art there is a need for a portable dynamic display device which can be used for large scale advertising and audiovisual presentations.

Statement of the Invention

DETAILED DESCRIPTION OF THE PREFERRED EMBODIMENTS

Figure 1:
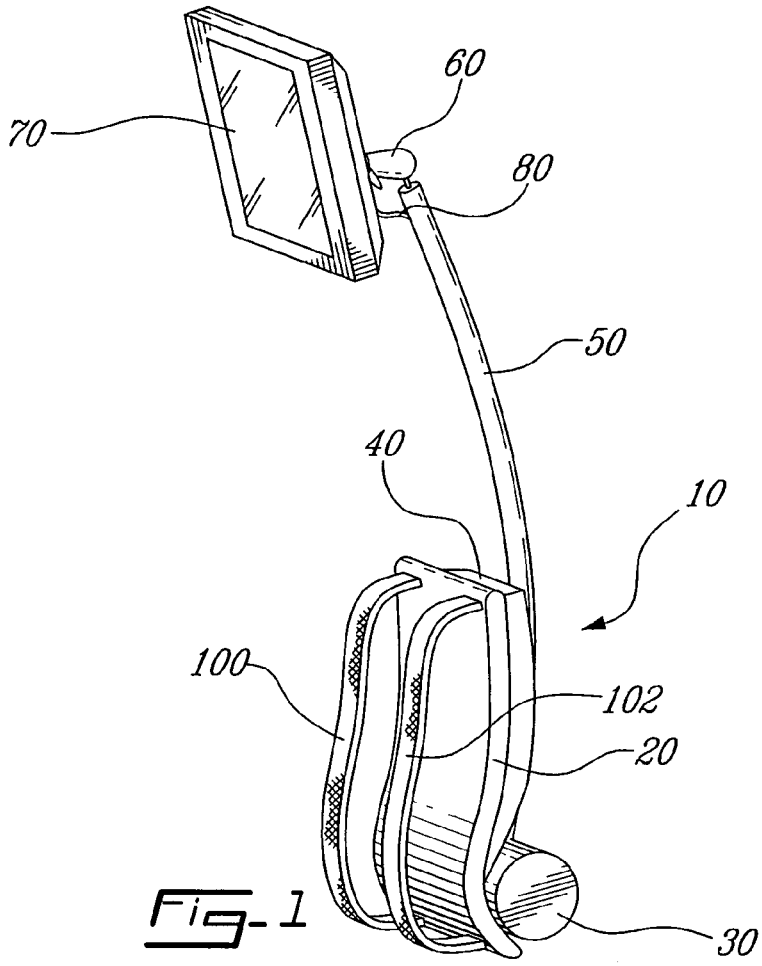
FIG. 1 is a side view of one embodiment of a portable dynamic display device according to the present invention.

In one aspect, as shown in FIG. 1, the present invention relates to a portable dynamic display device 10. The portable dynamic display device 10 comprises a general support frame 20, on which is mounted a base support means 30, and a carrying sack 40. A hollow tube 50 is attached at one end to the base support means 30. At the other end of hollow tube 50 is mounted a connecting means 60 which is used to attach display device 70 to the hollow tube 50.

The carrying sack 40 contains a media generating means (see below) which is connected to the display device 70 by a cable means 80, which allows for the media generating device to send a generated image to the display device 70 which can then show the image.

Figure 2:
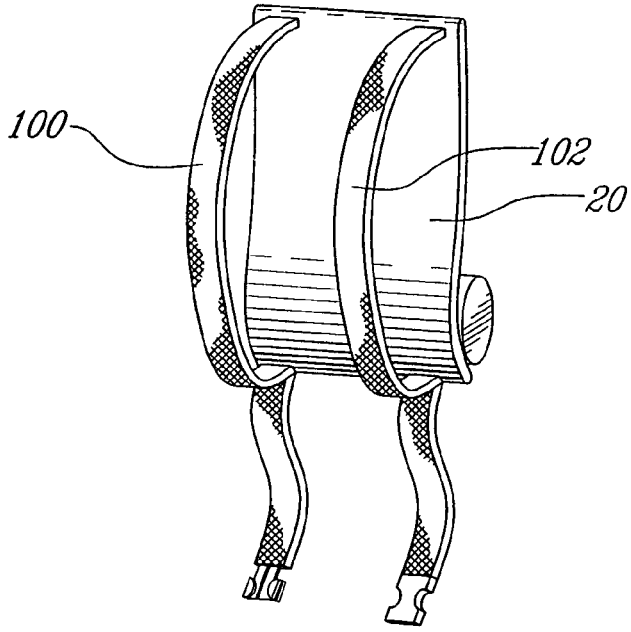
FIG. 2 is a front view of a support structure according to the embodiment of the invention shown in FIG. 1.

As can be seen in FIG. 2, the general support frame 20, comprises two lateral bars 90 and 92, which are held together by upper and lower bars 94 and 96. The general support frame 20 also has straps 100 and 102 which can be used to fasten the general support frame 20 to the body of a person.

Turning quickly back to FIG. 1. we see that general support frame 20 may have a curvature adapted to fit to the natural curvature of a persons body. This allows for greater comfort while carrying the device.

Figure 3:
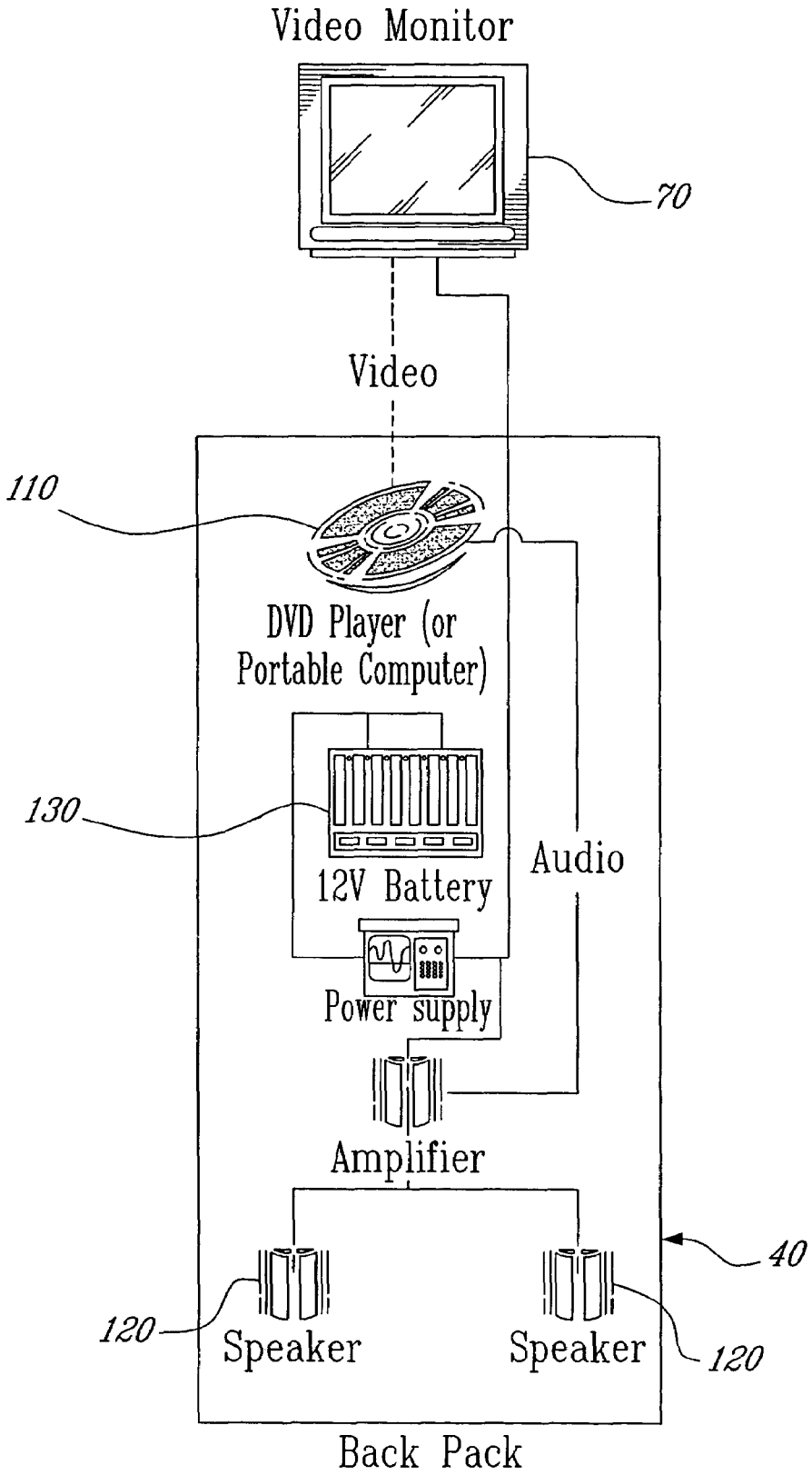
FIG. 3 is a diagram of the interior of a backpack of the embodiment of FIG. 1.

The backpack 40 may be made from a hard plastic shell, and may contain batteries, a media generating means (e.g. a DVD player or a portable computer), and speakers. One example of the contents of the backpack 40 may be seen in FIG. 3. The media generating means 110 generates and image based on a video program which can be stored on a storage means. Said storage means being readable by the media generating means 110.

The media generating means 110 is connected to the display device 70, and the speakers 120 such that the media generating means 110 can play back a video program from a storage means (e.g. a DVD disk or a MPEG-2 file), on the display device 70, and play sounds using the speakers 120. The speakers may also be placed on either end of the base support means 30.

Finally, the backpack 40, also contains a battery 130 or some other power supply which powers the speakers 120 and the display device 70. The media generating device 110 may have its own internal power supply or be powered by the battery 130.

Figure 4:
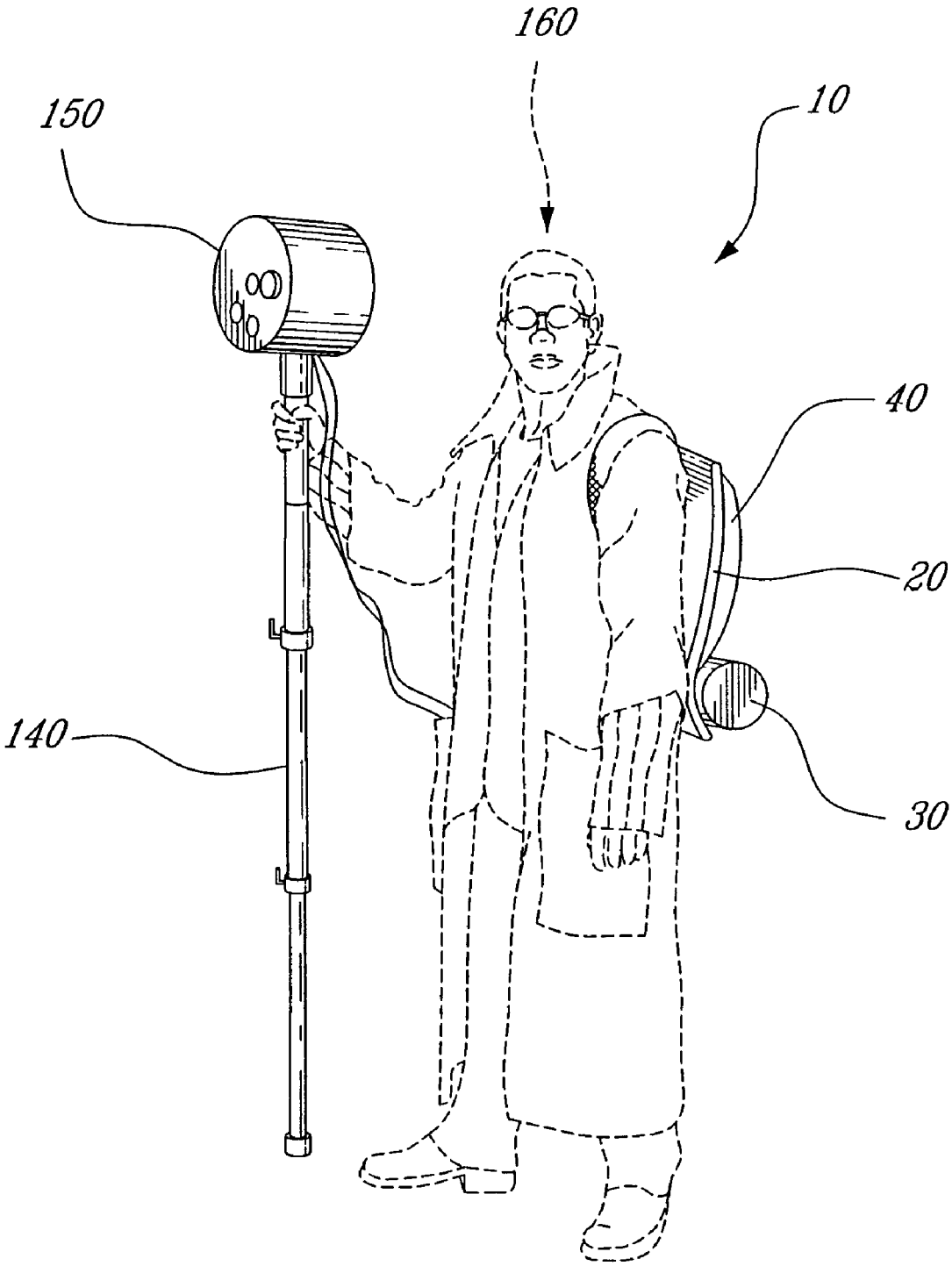
FIG. 4 is diagram of a second embodiment of the present invention.

In another embodiment of the invention, see FIG. 4, the display device 70 and the hollow tube 50 may be replaced by a telescoping pole 140 and projector 150. In this embodiment an media generating means stored in the backpack 40, will use the projector 150 to project images for viewing by an audience. The projector 150 may be mounted on a telescoping pole 140 such that an operator 160 can carry the projector 150 or support the projector on the ground via the telescoping pole 140.

Figure 5:
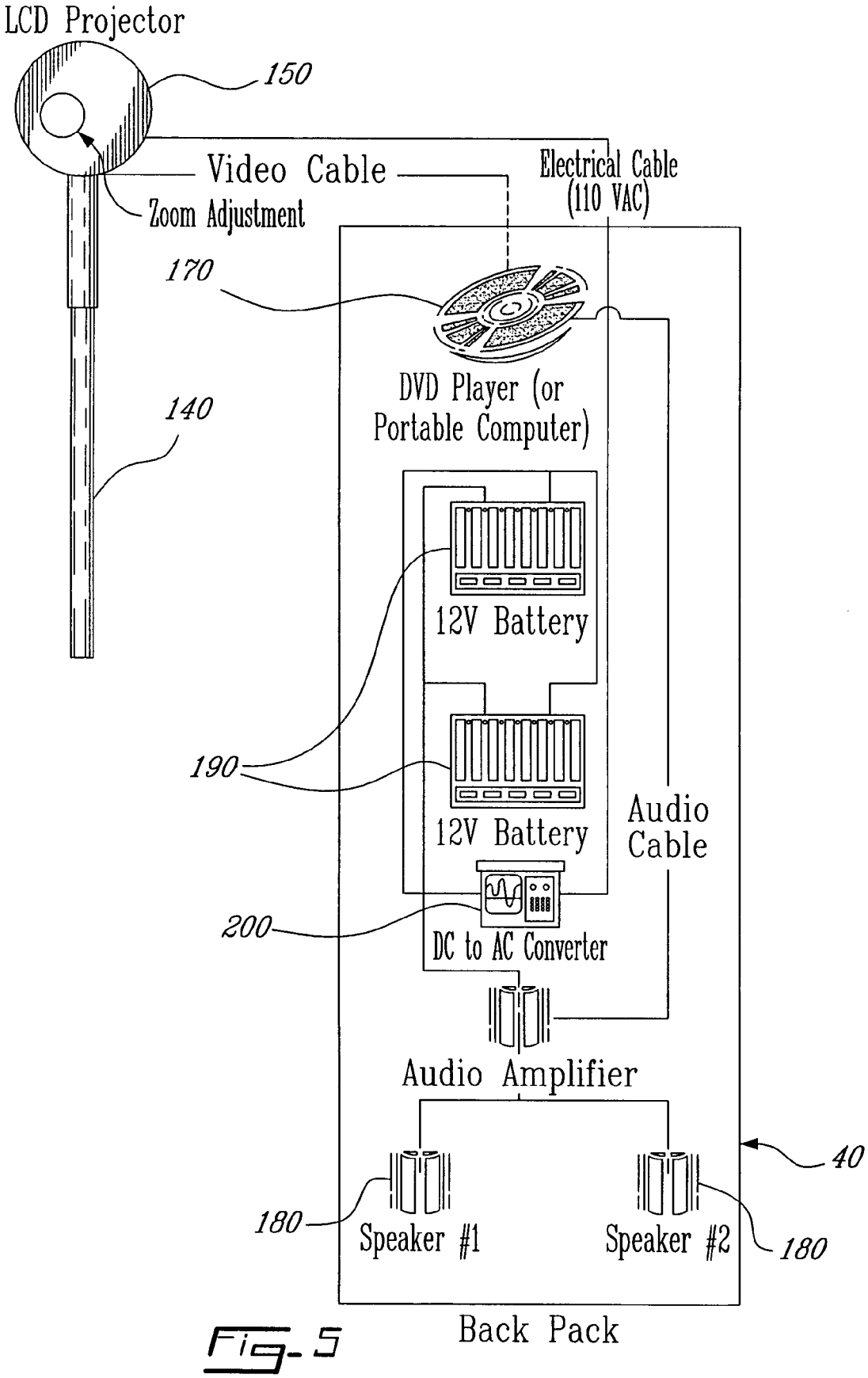
FIG. 5 is a diagram of the interior of a backpack of the embodiment of FIG. 4.
Figure 6:
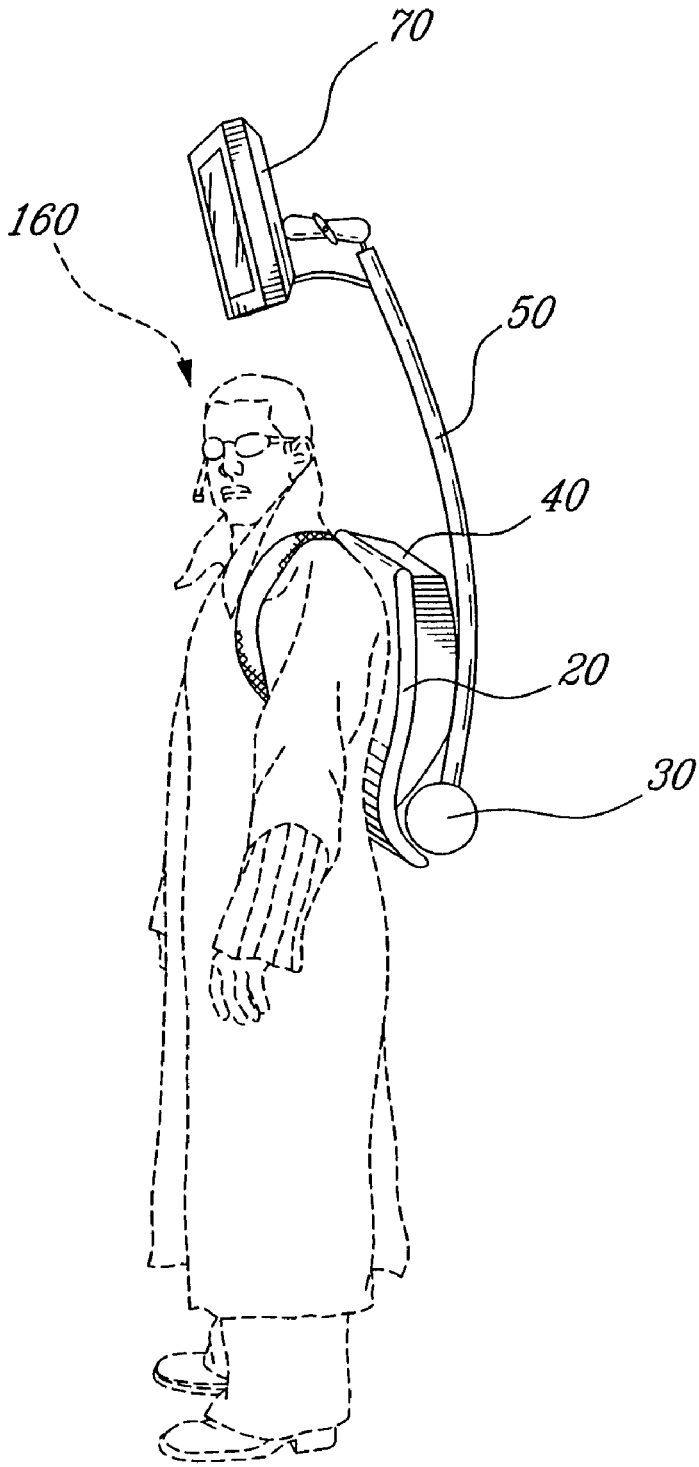
FIG. 6 is a diagram of the embodiment of the invention shown in FIG. 1.
Figure 7:
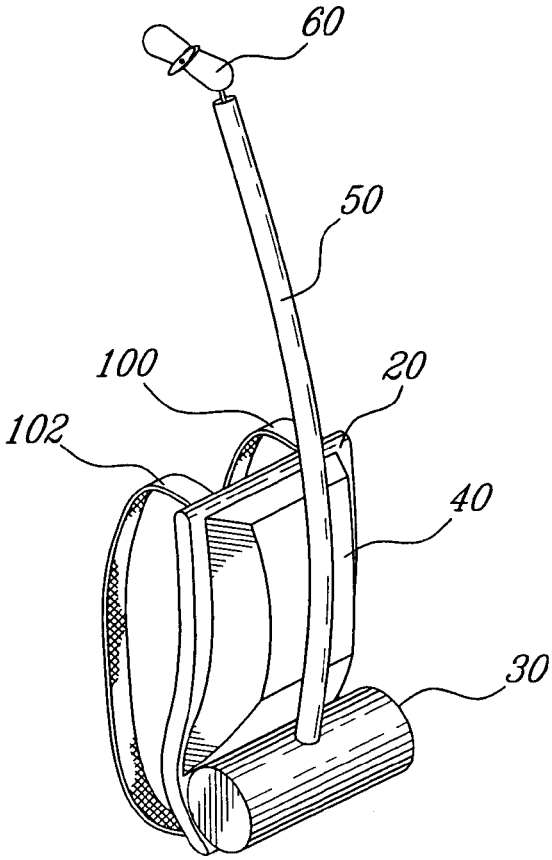
FIG. 7 is a perspective view of the invention according to the embodiment shown in FIG. 1, shown without a display device.
Figure 8:
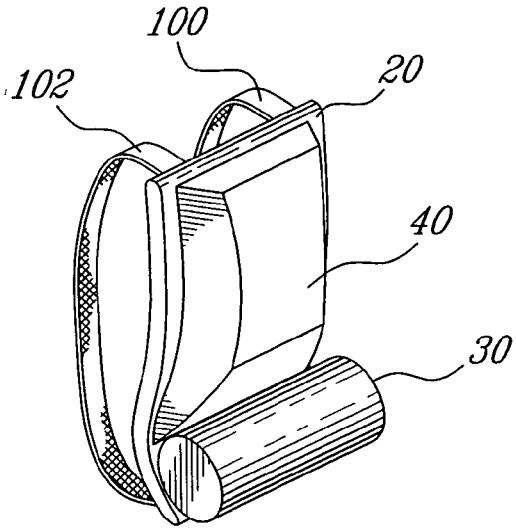
FIG. 8 is a perspective view of the invention according to the embodiment shown in FIG. 4, shown without a display device.

FIG. 5 shows a diagram of the contents of the backpack 40 in the case where a projector 150 is used. In this embodiment the backpack 40, may contain an media generating means 170, such as a DVD player or a portable computer. The media generating means 170 generates an image based on a video program stored on a storage means, for instance a DVD disk or a video file. The media generating means 170 is connected to the projector 150 such that said image generated by the media generating means 170 is projected by the projector 150.

Additionally, the media generating means 170 is connected to a pair of speakers 180 such that an audio component generated by said media generating means 170 can be played back on said speakers.

The backpack 40, also may contain a pair of batteries 190 which power the projector 150 and the speakers 180. The media generating means 150 may have a separate power source or may be connected to the batteries 190. The backpack 40, may also include a DC to AC converted 200 if a AC driven projector is used.

In another aspect the invention includes an out-of-home audiovisual presentation method comprising:

a) the use of a nomadic technology to provide the ability:
   a. to present audiovisual content in a moving fashion;
   b. to target the time of the presentation;
   c. to target the geographical area and the venues in which the content is presented;

b) a human being wearing audiovisual equipment providing the ability:
   i) to rapidly change the time or location of the presentation;
   ii) to interact with the audience verbally or with signs;
   iii) to distribute and hand out collateral materials directly to passerbys;

c) the use of commercially available equipment to enable:
   1. reproduction of existing broadcast quality and multimedia content in the MPEG-2encoding format;
   2. playback from any DVD that can be read with a commercial DVD player;
   3. playback from any software application that can run on a commercial portable computer;
   4. display of any visual content fit for television or computer screens;
   5. projection of any visual content for television or computer screens.

In another embodiment the invention may be a wearable and nomadic technology comprising:

a) a costume customizable to each specific activity and facilitating the integration to a specific event or product brand, comprising;
   i) a long trench coat designed for hiding the backpack straps;
   ii) a hat of round form;
   iii) pants to be worn under the trench coat;
   iv) semi-transparent mask and gloves;

b) a video monitor perched over the character's head on top of an inverse-T aluminum structure with the following specifications:
   i) a direct sunlight 1 viewable LCD display of suitable size;
   ii) a marine compliant (NEMA 4X) seal casing for watertight protection;
   iii) video inputs compatibility: Standard VGA/SVGA/XGA, Composite Video, S-Video;
   iv) resolutions: preferably 800×600 pixels, up to 1280×1024 pixels;
   v) on-screen display menu for video adjustments: position, size, brightness, contrast, etc.;

C) a backpack for the monitor set-up made of a hard plastic shell and containing:
   i) an inverse-T structure made of aluminum tubes
   ii) a low voltage DC audio amplifier (for example 10-watts), and two speakers (for example 10-watts) located on each side of the character's waist in the two extremities of the horizontal tube;
   iii) one or more batteries weighing as little as possible, and a low voltage DC regulated power supply;
   iv) a commercial type portable DVD player or a portable Windows-compatible computer, both having external audio and video output ports;

d) a video projector standing on a telescopic pole which may be held by the character at different heights and in different positions, with the following specifications:
   i) a LCD projector;
   ii) very light weight;
   iii) native resolution: true XGA 1024×768 or better;
   iv) data compatibility: all standard VESA modes, VGA, SVGA, XGA, and SXGA 85 Hz;
   v) video compatability: Full NTSC (M 4.43), PAL (BGHI, M, N), SECAM (M), HDTV (720p and 1080i RGBHV);

e) a backpack for the projector set-up made of a hard plastic shell containing:
   i) a light weight tube attached at the bottom of the backpack in the horizontal position;
   ii) a low voltage VDC audio amplifier, and two speakers located on each side of the character's waist;
   iii) one ore more batteries as light as possible, and a DC to AC electrical converter;
   iv) a commercial type portable DVD player or a portable Windows-compatible computer, both requiring external audio and video output ports and their own battery pack.

While the invention has been described in relation to several embodiments it will be apparent to those skilled in the art that several modifications and variations not mentioned exists. Accordingly the previous descriptions are only meant for the purposes of illustration, and are not meant to limit the scope of the invention.

The invention claimed is:

1. A portable display system comprising;
   a. a video image display for displaying a video image, said video image display being disposed on a support structure mountable on a human body;
   b. a storage device for storing at least one video program including data for generating said video image; and
   c. a media generating means operatively connected to said video image display and said storage device for receiving said at least one video program, generating said image, and sending signals to said video image display to display said video image;

wherein said support structure is mountable on the back of said human body and comprises:
   d. a general support frame having means for attaching said frame on said human body;
   e. a base support member attached to said frame;
   f. a generally vertically extending and elongated support member attached at one end to said base support member, and at the other end to said video image display;

wherein said elongated support member is disposed to support said video image display at a height higher than the head of said human body.

2. A portable display system as described in claim 1, wherein a carrying sack is mounted on said general support frame.

3. A portable display system as described in claim 2, wherein said media generating means and said storage device are located inside said carrying sack.

4. A portable display system at described in claim 1, wherein said portable display system further comprises at least one speaker connected to said media generating means.

5. A portable display system as described in claim 4, wherein said at least one speaker is located on said base support member.

6. A portable display system as described in claim 1, wherein said media generating means is a Digital Versatile Disk (DVD) player.

7. A portable display system as described in claim 1, wherein said media generating means is a portable computer.

8. A portable display system as described in claim 1, wherein said video image display is a liquid crystal display (LCD) screen.

9. A portable display system mountable on a person comprising:

a. support structure having a harness to removably mount on a person;

b. a video image display secured to said support structure to display an image;

c. a power supply;

d. a media generating means mounted on said support structure and connected to said power supply and said display to display an image on said display; and, e. an elongated member mounted to and between said support structure and said display, said elongated member extending upwardly from said support structure so said display elevating said display above said support structure and the person having the portable display system mounted thereon.

10. The display system of claim 9 wherein said power supply includes a battery.

11. The display system of claim 10 wherein said media generating means is a Digital Versatile Disk (DVD) player.

12. The display system of claim 10 wherein said support structure and said harness form a backpack that holds said power supply and said media generating means.

13. The display system of claim 12 wherein said support structure includes mounting bars with said harness fastened thereto along with said media generating means.

14. The display system of claim 13 wherein said media generating means includes a video output signal and an audio output signal to feed to said display.

15. A video display mountable upon a person to provide a video image at an elevation above the person wearing the display comprising:

a. a frame securable to a person;

b. a media generating means secured to said frame and having a video output signal;

c. a video display operatively associated with said media generating means and having a video screen to receive said video output signal end display an image on said video screen; and, d. an elongated member positioned between and connected to said frame and said video display unit positioning said video display unit at a higher elevation relative to said frame and said person.

16. The video display system of claim 15 and further comprising a power supply connected to said media generating means.

17. The video display system of claim 16 wherein said video screen is a liquid crystal display (LCD) screen.

18. The video display system of claim 15 wherein said frame includes a harness, mounting bars and base support member, said elongated member being connected to and between said base support member and said video display unit.

19. The video display system of claim 15 and further comprising a power supply connected to said media generating means with said power supply having a direct current output.

20. A video display system mountable upon a person to provide a video image for others to see comprising:

a. a support wearable by said person;

b. an elongated member wearable by said person;

c. a media generating unit mounted to said support and having an output video signal; and, d. a video display screen mounted to said elongated member, said elongated member elevating said video display screen whereby said video display screen is located above the media generating unit, the support and the person when worn, said video display screen to receive said output video signal and display a video image corresponding to said output video signal thereon.

21. The video display system of claim 20 wherein said power unit includes a battery with a direct current output and further comprising a direct current regulator to regulate said direct current output to power said media unit and said video display screen.

22. The video display system of claim 21 wherein said support includes a base support member with said elongated connected to and between said base support member and said video display screen.

* * * * *